US005123991A

United States Patent [19]

Tsuda

[11] Patent Number: 5,123,991

[45] Date of Patent: Jun. 23, 1992

[54] BOX SEALER

[75] Inventor: Masaaki Tsuda, Yokohama, Japan

[73] Assignee: Kabushiki Kaisha Takara, Osaku, Japan

[21] Appl. No.: 599,391

[22] Filed: Oct. 19, 1990

[30] Foreign Application Priority Data

Oct. 19, 1989 [JP] Japan ..... 1-122313[U]
Apr. 11, 1990 [JP] Japan ..... 2-38689[U]

[51] Int. Cl.[5] ..... B31B 1/72

[52] U.S. Cl. ..... 156/494; 156/523; 53/76; 493/116

[58] Field of Search ..... 156/355, 494, 523; 493/22, 116; 53/76

[56] References Cited

U.S. PATENT DOCUMENTS 2,841,305 7/1958 Werner ..... 156/355
3,466,843 9/1969 Mumper ..... 53/76
3,488,243 1/1980 Pesch et al. ..... 156/355
4,605,457 8/1986 Guy ..... 156/494
4,846,921 7/1989 Lerner et al. ..... 156/518

FOREIGN PATENT DOCUMENTS 51-38926 3/1976 Japan .
52-679 1/1977 Japan .

*Primary Examiner*—Robert A. Dawson
*Assistant Examiner*—David Reifsnyder
*Attorney, Agent, or Firm*—Wenderoth, Lind & Ponack

[57] ABSTRACT

The present invention provides a box sealer for attaching adhesive tape in an L-shape on corners of a box for medical drugs, cosmetics, etc. The box is first received at a rectangular corner furnished on a top surface of the box sealer, and adhesive tape of a predetermined dimensions is sent out from below and is cut. By sliding attachment plates at the corner of one side and at the bottom of the box, the adhesive tape is attached in the L-shaped form. Knurled rollers for sending out the adhesive tape are furnished in tandem, and one of the rollers is rotated by twice as many revolutions as the other roller. Further, a microswitch for detecting the box and rotating a motor is mounted near the rectangular window of the housing, and a pair of operating pins of the microswitch are provided in parallel.

8 Claims, 4 Drawing Sheets

BOX SEALER

BACKGROUND OF THE INVENTION (1) Field of the Invention

The present invention relates to a box sealer for sealing a box by attaching adhesive tape in an L-shape form on the corners of the box. In particular, the invention relates to a box sealer for sealing a box for medical drugs, cosmetics, etc. by attaching the adhesive tape cut into a certain length on the corners of the box, which has an accommodating unit and a cover integrally connected with each other on one side.

(2) State of the Prior Art

In general, a box for packing medical drugs, cosmetics, etc. is placed in a larger box or container in the manufacturing process. These are sent to retail shops and consumers through a distribution route. It is customary to attach tape, sealant, etc. on the openings (such as the cover) of the box in order to prevent pilferage or falsification of the contents of the box (note e.g. Japanese Patent Publication No. 52-679, or Japanese Utility Model Publication No. 51-38926).

However, the conventional box sealers using adhesive tape of this type have common disadvantages in that the box is often deformed when the tape is attached because of the driving movement of the attaching roller or the releasing momentum of the adhesive tape when the box is soft. For this reason, the box sealer could not be used for such boxes, and the taping must be performed manually.

SUMMARY OF THE INVENTION

To solve the above problems, it is the object of the present invention to provide a box sealer wherein a box is first received at a rectangular corner on a top surface of the box sealer. An adhesive tape of a predetermined dimension is emitted from below, and the adhesive tape is attached in an L-shape form on the box by sliding attachment plates on the side and bottom corners of the box.

The box sealer according to the present invention is characterized in that a rectangular step for positioning a box is provided at a particular depth on a box feeding surface. The box feeding surface is formed on a frontal portion of a housing having an adhesive tape reel protruding at a rear end thereof. A switch for feeding tape is mounted at a vertical opening of a rectangular window at the center of the rectangular step. Knurled rollers driven by a tape feeding motor are disposed in the housing, with tape detachment plates pushed into notched grooves of the knurled rollers. A side attachment plate is driven by a motor, the motor being rotated by activating the switch. The side attachment plate is on a side of the vertical opening of the rectangular window. A bottom attachment plate is moved toward the horizontal window on an operating member having a cutter provided thereon.

With the arrangement as described above, adhesive tape is pulled out of the tape reel, and the tape is sent with its adhesive side facing toward the surface of the knurled rollers, which rollers have notched grooves at the center of their peripheral surfaces. A tape detachment plate is engaged with the notched grooves of the knurled rollers from the non-adhesive side of the adhesive tape to form the tape into a V-shape. The tape is then sent straightforwardly to the rectangular window, and the tip of the tape is brought to the vertical opening.

Then, the box to be taped is moved by sliding the box over the box feeding surface. When the box reaches the deepest L-shaped end of the surface, forming a rectangular step, the switch is turned on by being pushed by operating pins of a microswitch mounted on the vertical opening, and a tape-feeing motor is rotated. This further rotates the knurled rollers, which send the adhesive tape a predetermined length out to a side attachment plate at the vertical opening. The side attachment plate motor is rotated by one turn by the switch, and an operating member sides along a slide guide by action of a rocking bar of a crank mechanism interlocked with the motor. The adhesive tape is pushed and attached on the side of the box by the side attachment plate being furnished on an end surface of the operating member. The tape sent out straightforwardly is cut by the cutter, which is moved with the attachment plate, and the adhesive tape is pushed and attached on the box bottom from the corner of the box by the bottom attachment plate, which slides integrally with the cutter.

BRIEF DESCRIPTION OF THE DRAWINGS

The drawings show an embodiment of this invention.

DESCRIPTION OF THE PREFERRED EMBODIMENT

Figure 1:
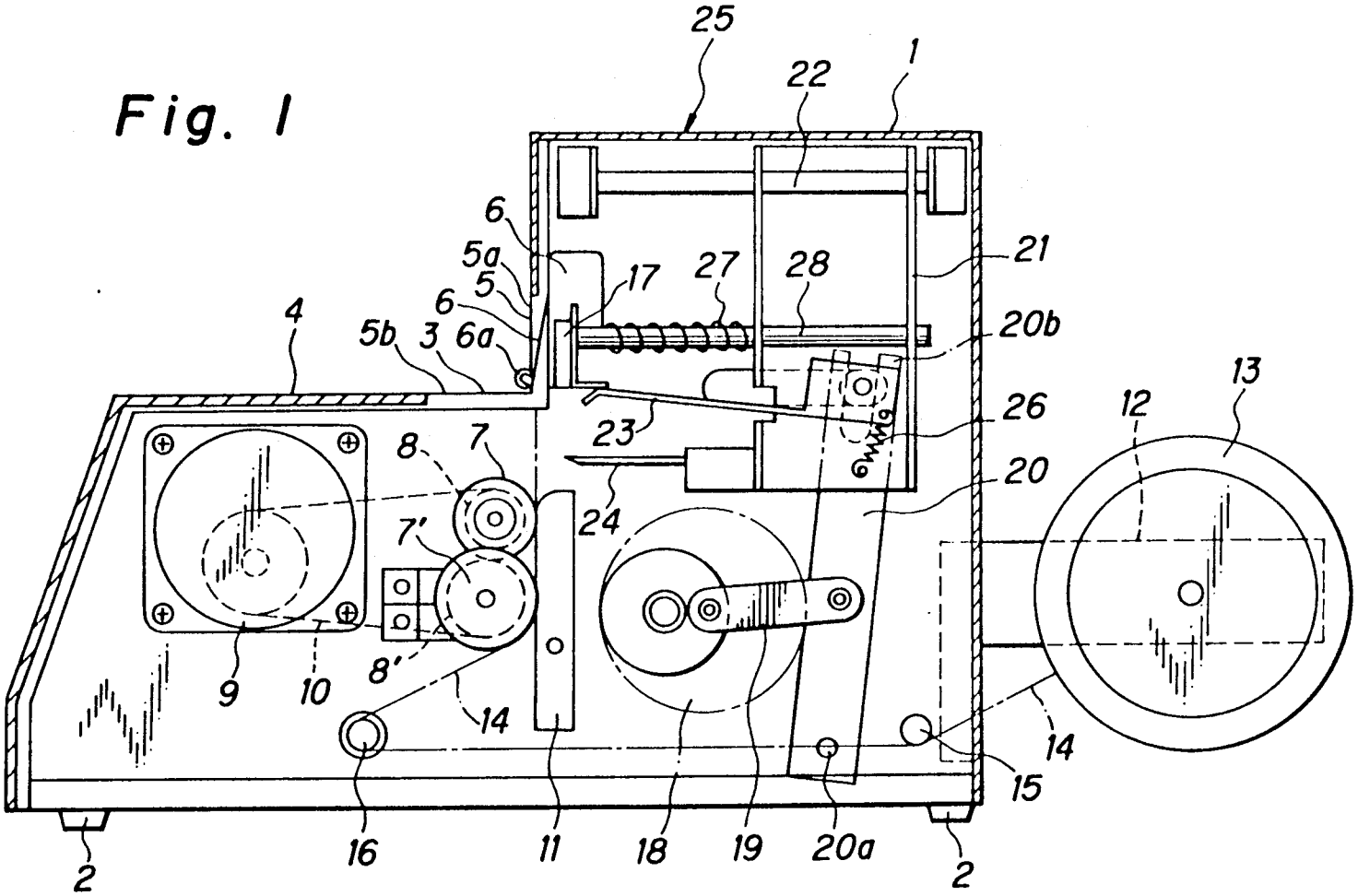
FIG. 1 is a side view showing the inside of a box sealer according to the invention.
Figure 2:
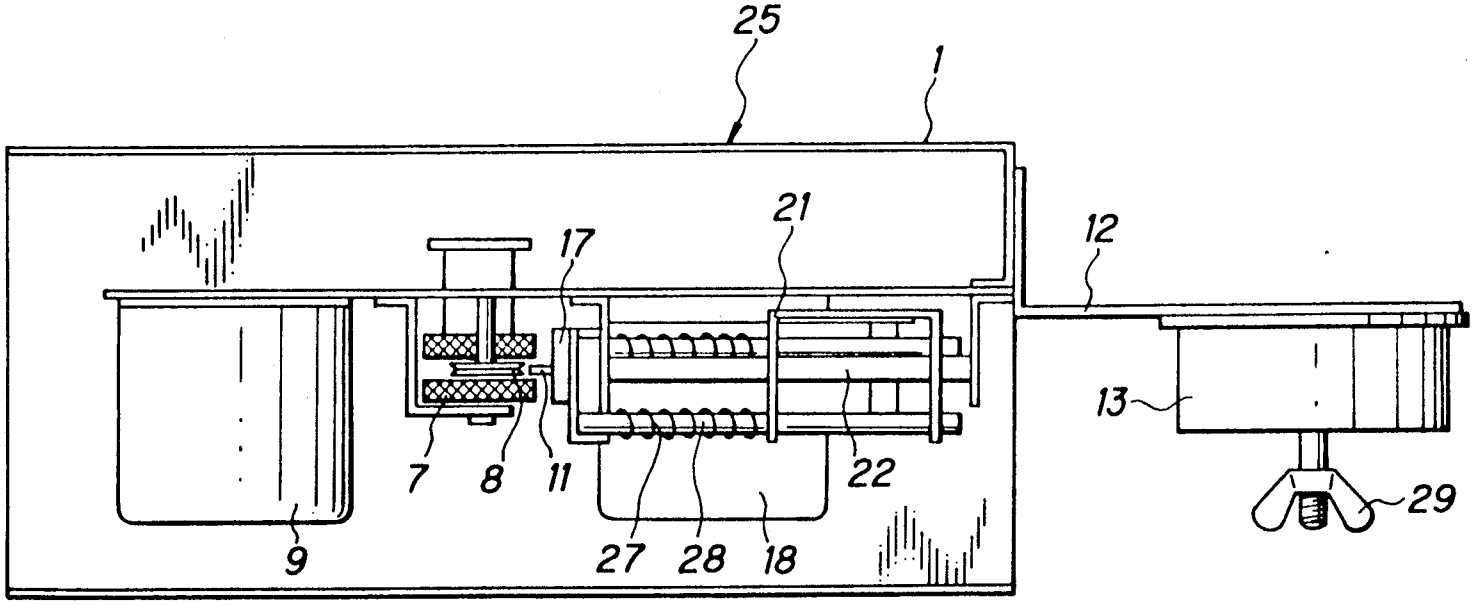
FIG. 2 is a plan view of the same.
Figure 3:
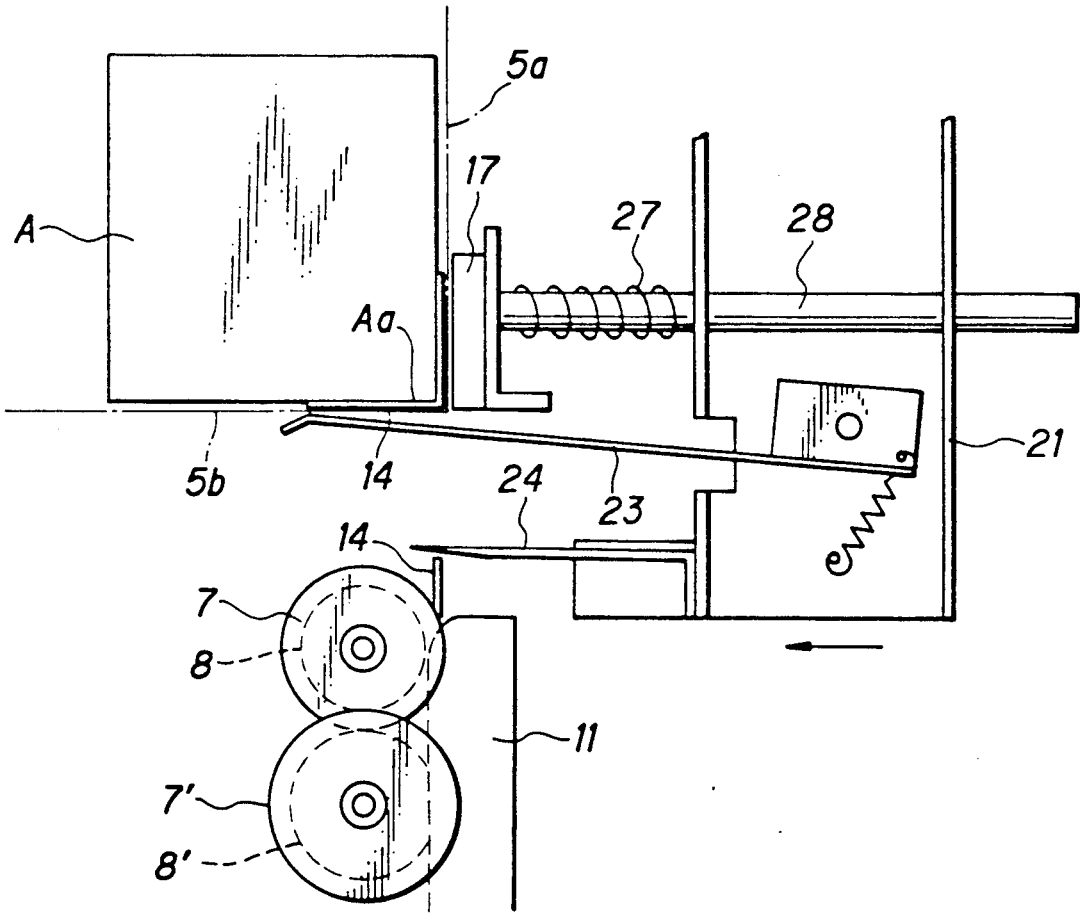
FIG. 3 illustrates the box sealer of FIG. 1 in an operation of attaching adhesive tape to a box.
Figure 4:
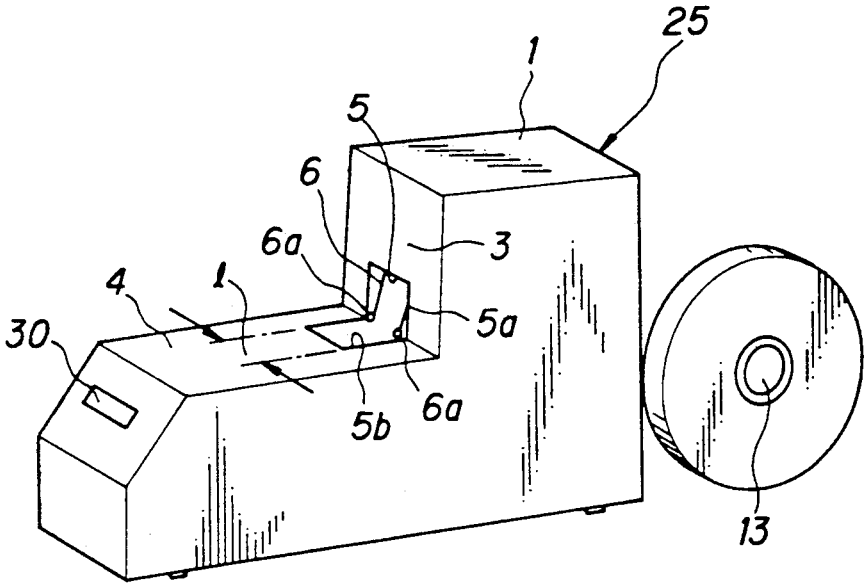
FIG. 4 is a general perspective view of the box sealer of FIG. 1.
Figure 5:
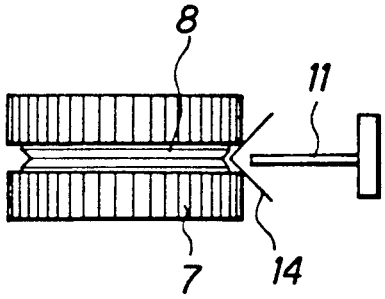
FIG. 5 illustrates the formation of adhesive tape in a desired shape in the box sealer of FIG. 1.

In the following, the features of the invention are described in connection with the drawings of a preferred embodiment thereof.

A housing 1 is furnished with pedestals 2 and a rectangular step 3 in the middle of a top surface thereof. The flat surface in front of the rectangular step is a box feeding surface 4. A rectangular window 5 has a predetermined width and opens on the rectangular step 3. Inside a vertical opening 5*a* of the rectangular window 5 are a pair of operating pins 6*a* of a miroswitch 6 mounted in parallel to the vertical opening 5*a*. Knurled rollers 7 and 7' are furnished with notched grooves 8 and 8' on peripheral surfaces thereof and are arranged in tandem below the rectangular window 5 within the housing 1. One knurled roller 7 has a smaller diameter so that it can be rotated by twice as many revolutions as the other roller 7'. The knurled rollers 7 and 7' are rotated by a ladder chain 10, which is driven by a tape feeding motor 9 rotated when the switch 6 is activated and turned on. A detachment plate 11 facing the outer peripheral surfaces of the knurled rollers 7 and 7' is pushed into the notched grooves 8 and 8' and fixed in vertical position. A supporting arm 12 is furnished at the rear end of the housing 1. The adhesive tape 14, taken from a tape reel mounted on the supporting arm 12, is guided through guide rollers 15 and 16 and is passed between the knurled rollers 7 and 7' and the detachment plate 11.

The adhesive tape 14 is then formed in a V-shape and is sent to the rectangular window 5, which opens above the knurled rollers 7 and 7'. A side attachment plate 17 has an elastic substance such as rubber attached thereon and is mounted near the vertical opening 5*a* of the rectangular window 5. The side attachment plate 17 is mounted on an operating member 21, which is engaged with the tip of a rocking bar 20. The rocking bar 20 is moved by a crank mechanism 19 mounted on a cutting motor 18, which is rotated by one turn when the microswitch 6 is turned on. Guided by a slide guide 22 and supported horizontally in the housing 1, the operating member 21 is slidably moved. A bottom attachment plate 23 is horizontally mounted toward the rear end of the side attachment plate 17. A cutter 24 protrudes below the bottom attachment plate 23 so that the tip thereof extends above the detachment plate 11. A box sealer 25 is formed by this arrangement. A tension spring 26 pushes the bottom attachment plate 23 permanently toward the side attachment plate 17, and a buffer spring 27 is mounted on a support shaft 28 of the side attachment plate 17.

Next, a description is given of the operation of the box sealer 25. To use the box sealer 25, the adhesive tape reel 13 is mounted on the supporting arm 12 and adjusted by an adjusting screw 29. The adhesive tape 14 is guided through the guide rollers 15 and 16 and is passed between the knurled rollers 7 and 7' and the detachment plate 11.

When the cover Aa of a box A is to be sealed by the adhesive tape 14, the box A is placed on the box feeding surface 4 of the housing 1 at the L-shaped corner. When the box is moved on the rectangular step 3 to its complete depth, it pushes the operating pins 6*a* of the microswitch 6 furnished in parallel near the vertical opening 5*a* of the rectangular window 5. Then the switch 6 is turned on, and the tape feeding motor 9 is driven, rotating the knurled rollers 7 and 7'. The adhesive tape 14 is then squeezed between the knurled rollers 7 and 7' and the detachment plate 11 being pushed into the notched grooves 8 and 8' of the knurled rollers 7 and 7' and formed in to a V-shape. The tape is then sent out straightforwardly by a predetermined length along the vertical opening 5*a* of the above rectangular window 5.

Of the knurled rollers 7 and 7' furnished in series and in tandem, one roller 7 has a smaller diameter and is rotated by twice as many revolutions as the other roller 7', and the adhesive tape 14 is sent out of the vertical opening so that the adhesive side of the tape is detached from the knurled surface. This prevents the erroneous operation caused by the entanglement of adhesive tape with the knurled rollers.

The cutting motor 18 is driven by one turn by the microswitch 6, and this drives the crank mechanism 19. A tip 20*b* of the rocking bar 20 moves leftward in FIG. 1 with a point 20*a* at the base end thereof functioning as a pivot. Thus the operating member 21 connected with the tip 20*b* slides, and the adhesive tape 14 is pushed by the side attachment plate 17. The side attachment plate moves integrally with the operating member 21 toward the vertical opening 5*a*, attaching the tape on the side surface of the box A. At the same time, the cutter 24 mounted on the end of the operating member 21 pushes on the adhesive tape 14 from the lateral direction and cuts the adhesive tape. Then the rear end of the adhesive tape, which has been cut into a predetermined length, is received by the end of the bottom attachment plate 23 mounted on the operating member 21. The bottom attachment plate 23 slides along a horizontal window 5*b*, and the adhesive tape 14 is pushed onto the surface of the cover Aa of the box A and is attached to it. Namely, the adhesive tape 14, cut into a predetermined length by the cutter 24, is attached on two surfaces, which are formed in an L-shape relative to the box A by the side attachment plate 17 and the bottom attachment plate 23, and the opening corner of the box is sealed. A preset counter 30 adjusts the length of the tape to be sent out.

As described above, the box sealer according to the present invention is provided with a rectangular step at a depth of the box feeding surface and with a rectangular window in the step. Further, it comprises a microswitch to detect a box at the rectangular window, a side attachment plate, a bottom attachment plate and a cutter, slidably moving in response to the activation of the switch. Thus the operation of attaching and sealing the adhesive tape on the box can be easily and assuredly performed by simply placing the box on the box feeding surface and by pushing it toward the rectangular step.

Moreover, it is possible according to this invention to attach the tape on the corner of the box by sliding the side attachment plate and the bottom attachment plate, which are mounted on the operating member. Accordingly, the tape can be attached without deforming the box even when the box is soft and fragile.

Because a pair of operating pins are furnished in parallel on the microswitch to detect the box at the rectangular window, the microswitch is not turned on unless the side of the box is brought close to the rectangular window, and this eliminates erroneous attachment of the adhesive tape.

Further, the knurled rollers sending out adhesive tape are provided in tandem and in series, and one of the rollers is rotated by twice as many revolutions as the other roller. Thus, adhesive tape is sent out toward the vertical opening so that it is detached from the knurling surface, and this prevents erroneous operation due to the entanglement of the tape on the knurled roller.

What we claim is:

1. A box sealing apparatus, comprising:

a housing having a horizontal box feeding surface thereon, a step being formed by said housing with said box feeding surface for receipt of a box to be sealed, said housing further having an opening therein communicating the interior of said housing with said step;

an adhesive tape reel mounted to said housing for supplying adhesive tape;

a plurality of knurled rollers mounted for rotation inside said housing for feeding adhesive tape from said adhesive tape reel to said opening, said knurled rollers having notched grooves in the peripheral surfaces thereof;

a tape feeding motor operably connected to said knurled rollers for rotating said rollers for feeding adhesive tape;

a tape detachment plate adjacent said notched grooves of said knurled rollers for being received by said notched grooves;

a means for attaching adhesive tape fed by said knurled rollers to a corner of a box positioned on said step at said opening, said means comprising a side attachment plate for attaching the adhesive tape to a side of the box at its corner, a bottom attachment plate for attaching the adhesive tape to the bottom of the box, a cutter for cutting the adhesive tape and a motor for driving said side and bottom attachment plates and said cutter; and a switch means mounted at said opening for activating said tape feeding motor to feed adhesive tape to said opening and activating said motor of said means for attaching to attach the adhesive tape to a box in response to a box engaging said switch means.

2. The apparatus of claim 1, wherein said knurled rollers are disposed below said opening in said housing so as to feed the adhesive tape vertically up to said opening, and said side and bottom attachment plates and said cutter are mounted for horizontal sliding movement in said housing toward said opening for cutting and attaching the adhesive tape.

3. The apparatus of claim 2, wherein said means for attaching includes a slide guide in said housing having an operating member horizontally slidably connected thereto, a rocking bar for sliding said operating member on said slide guide and a crank mechanism for operably connecting said motor of said means for attaching to said rocking bar for reciprocal movement thereof, wherein said side and bottom attachment plates and said cutter are mounted on said operating member.

4. The apparatus of claim 3, wherein said cutter is fixed to said operating member, said bottom attachment plate is pivotably mounted on said operating member and biased upwardly, and said side attachment plate is slidably mounted on said operating member by a support shaft and horizontally biased toward said opening.

5. The apparatus of claim 1, wherein there are two said knurled rollers disposed in series with respect to the direction of feed of the adhesive tape, said tape feeding motor rotating one said knurled roller twice as fast as the other said knurled roller, in terms of the number of revolutions thereof.

6. The apparatus of claim 1, wherein said switch means comprises a microswitch having a pair of operating pins disposed next to said opening.

7. The apparatus of claim 1, wherein said opening comprises a vertical opening formed in a vertical surface of said housing defining an interior right angle together with said box feeding surface and a horizontal opening in said box feeding surface.

8. The apparatus of claim 1, wherein said vertical and horizontal openings are rectangular.

* * * * *